US012117211B2

(12) United States Patent
Que

(10) Patent No.: US 12,117,211 B2
(45) Date of Patent: Oct. 15, 2024

(54) SYSTEMS FOR REVERSE AIRFLOW DAMAGE PREVENTION IN APPLIANCES

(71) Applicant: Haier US Appliance Solutions, Inc., Wilmington, DE (US)

(72) Inventor: Chenlong Que, Shanghai (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/796,422

(22) PCT Filed: Apr. 29, 2022

(86) PCT No.: PCT/CN2022/090200

§ 371 (c)(1),
(2) Date: Jul. 29, 2022

(87) PCT Pub. No.: WO2023/206336

PCT Pub. Date: Nov. 2, 2023

(65) Prior Publication Data

US 2024/0183581 A1 Jun. 6, 2024

(51) Int. Cl.
*F24H 9/20* (2022.01)
*F24H 9/1836* (2022.01)

(52) U.S. Cl.
CPC ..... *F24H 9/2042* (2013.01); *F24H 9/1836* (2013.01)

(58) Field of Classification Search
CPC ..... F24H 9/1836; F24H 9/2042; F24H 1/101; F24H 1/145; F22B 35/001; F22B 37/06; F23B 80/04; F16K 24/00
See application file for complete search history.

(56) References Cited

U.S. PATENT DOCUMENTS 6,606,968 B2 8/2003 Iwama et al.
7,322,532 B2 1/2008 Takada et al.
(Continued)

FOREIGN PATENT DOCUMENTS

AU 2009201356 A1 * 10/2010 ..... F23J 11/12
CN 109990486 A 7/2019
(Continued)

OTHER PUBLICATIONS

International Search Report Corresponding to Application No. PCT/CN2022/090200 on Dec. 21, 2022.
(Continued)

*Primary Examiner* — Gregory A Wilson
(74) *Attorney, Agent, or Firm* — Dority & Manning, P.A.

(57) ABSTRACT

A water heater includes a case, and a water line disposed within the case. The water line extends between an inlet and an outlet, and a heat exchanger is disposed in the case on the water line. A burner is disposed in the case, and a controller is also disposed in the case. A flue is coupled to the case. The flue defines an exhaust outlet contiguous with external air. The flue includes a temperature sensor, a fan, and a plate disposed within the flue. The plate is configured to rotate within the flue between an open position and a closed position. Also included in the case is a heating element coupled to the water line between the inlet and the outlet of the water line. The controller is in signal communication with the temperature sensor and the fan, and the controller is in operative communication with the heating element.

16 Claims, 4 Drawing Sheets

(56) References Cited

U.S. PATENT DOCUMENTS

| | | | | |
|---|---|---|---|---|
| 7,814,868 | B2 * | 10/2010 | Yin | F24H 9/0031 122/13.01 |
| 9,732,984 | B2 * | 8/2017 | Yano | F24H 1/124 |
| 2008/0098967 | A1 * | 5/2008 | Garg | F23C 9/08 122/155.1 |
| 2008/0197205 | A1 | 8/2008 | Ene et al. | |
| 2014/0116357 | A1 | 5/2014 | Yano et al. | |
| 2019/0170398 | A1 | 6/2019 | Chaudhry et al. | |

FOREIGN PATENT DOCUMENTS

| | | | | | |
|---|---|---|---|---|---|
| CN | 110986371 | A | | 4/2020 | |
| CN | 111811133 | A | * | 10/2020 | F24H 1/145 |
| DE | 202016107463 | U1 | * | 3/2017 | |
| JP | 2007322004 | A | | 12/2007 | |
| KR | 950009266 | B1 | | 8/1995 | |
| WO | WO2006080223 | A1 | | 8/2006 | |
| WO | WO-2017143275 | A1 | * | 8/2017 | F24H 1/009 |

OTHER PUBLICATIONS

Takagi, "Flash Water Heater Model T-K2", Instantaneous Water Heater Installation Manual and Owner's Guide, Takagi Industrial Co. USA Inc., Irvine, CA, pp. 1-28.

* cited by examiner

SYSTEMS FOR REVERSE AIRFLOW DAMAGE PREVENTION IN APPLIANCES

CROSS-REFERENCE TO RELATED APPLICATIONS

The present application is the National Stage Entry of and claims the benefit of priority under 35 U.S.C. § 371 to PCT Application Serial No. PCT/CN2022/090200 filed Apr. 29, 2022 and entitled SYSTEMS FOR REVERSE AIRFLOW DAMAGE PREVENTION IN APPLIANCES, which is hereby incorporated by reference in its entirety for all purposes.

FIELD OF THE INVENTION

The present subject matter relates generally to preventing reverse airflow in appliances.

BACKGROUND OF THE INVENTION

Gas tankless water heaters differ from conventional water heaters in that a large volume of heated water is not stored in a large tank but flows through a heat exchanger where the water is quickly heated. The heat exchanger may have a burner within a combustion chamber that provides the heat to the water flowing through the heat exchanger. The combustion products, such as exhaust, then leave the system through a flue and into the outside air. In the water heater, when cold outside air flows in through the flue, pipes can crack, and flow sensors can break.

BRIEF DESCRIPTION OF THE INVENTION

Aspects and advantages of the invention will be set forth in part in the following description, or may be apparent from the description, or may be learned through practice of the invention.

A water heater includes a case, and a water line disposed within the case. The water line extends between an inlet and an outlet, and a heat exchanger is disposed in the case on the water line. A burner is disposed in the case, and a controller is also disposed in the case. The controller is in operative communication with the burner and is configured to selectively activate the burner in order to heat water in the water line via the heat exchanger. A flue is coupled to the case. The flue defines an exhaust outlet contiguous with external air. Also, the flue is configured to vent combustion gases from the burner to the external air through the exhaust outlet. The flue includes a temperature sensor, a fan, and a plate disposed within the flue. The plate is configured to rotate within the flue between an open position and a closed position. The plate is positioned to allow exhaust air to exit the flue in the open position of the plate, as well as the plate is also configured to block the exhaust air and prevent external air from entering the case through the flue in the closed position of the plate. Also included in the case is a heating element coupled to the water line between the inlet and the outlet of the water line. The controller is in signal communication with the temperature sensor and the fan, and the controller is in operative communication with the heating element. The controller is configured to selectively activate the heating element based at least in part on one or both of a signal from the temperature sensor and a signal from the fan.

A water heater includes a housing and a water line disposed within the housing. The water line extends between an inlet and an outlet, and a heat exchanger is disposed in the housing on the water line. A burner is disposed in the housing and an exhaust duct connector extends through the housing. A controller is disposed on the housing and the controller is in operative communication with the burner and configured to selectively activate the burner in order to heat water in the water line. A flue is coupled to the exhaust duct connector, and the flue defines an exhaust outlet contiguous with external air. The flue is configured to vent combustion gases from the burner to the external air through the exhaust outlet. The flue includes a temperature sensor, a fan, and a plate disposed within the flue. The plate is configured to rotate within the flue between an open position and a closed position. The plate is positioned to allow exhaust air to exit the flue in the open position of the plate. The plate is also configured to block the exhaust air and prevent external air from entering the housing through the flue in the closed position of the plate. Additionally, a heating element is coupled to the water line between the inlet and the outlet of the water line. The controller is in signal communication with the temperature sensor and the fan, and the controller is in operative communication with the heating element. Also, the controller is configured to selectively activate the heating element based at least in part on one or both of a signal from the temperature sensor and a signal from the fan.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
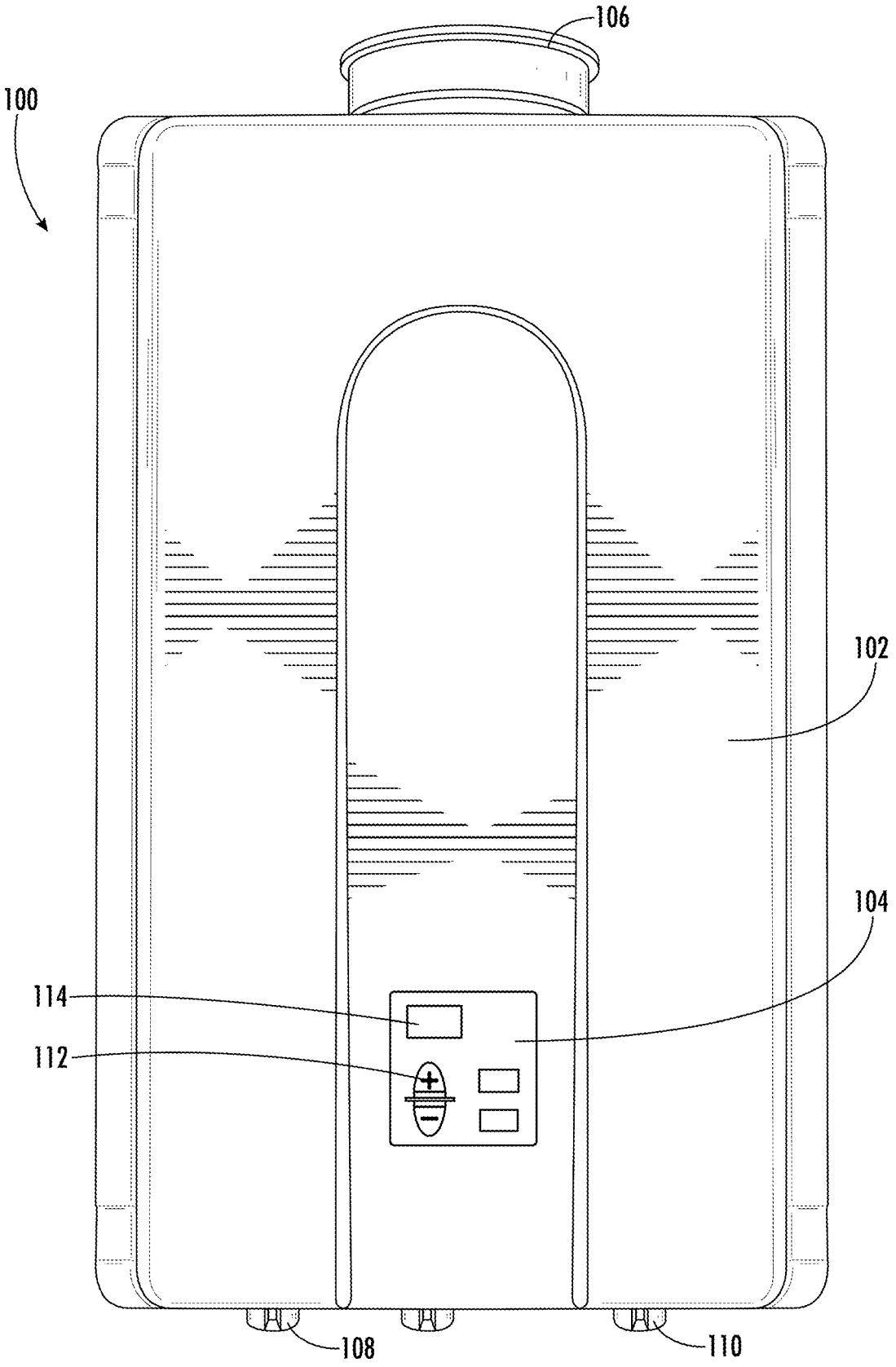
FIG. 1 provides a front view of an example embodiment of a gas, tankless water heater according to the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
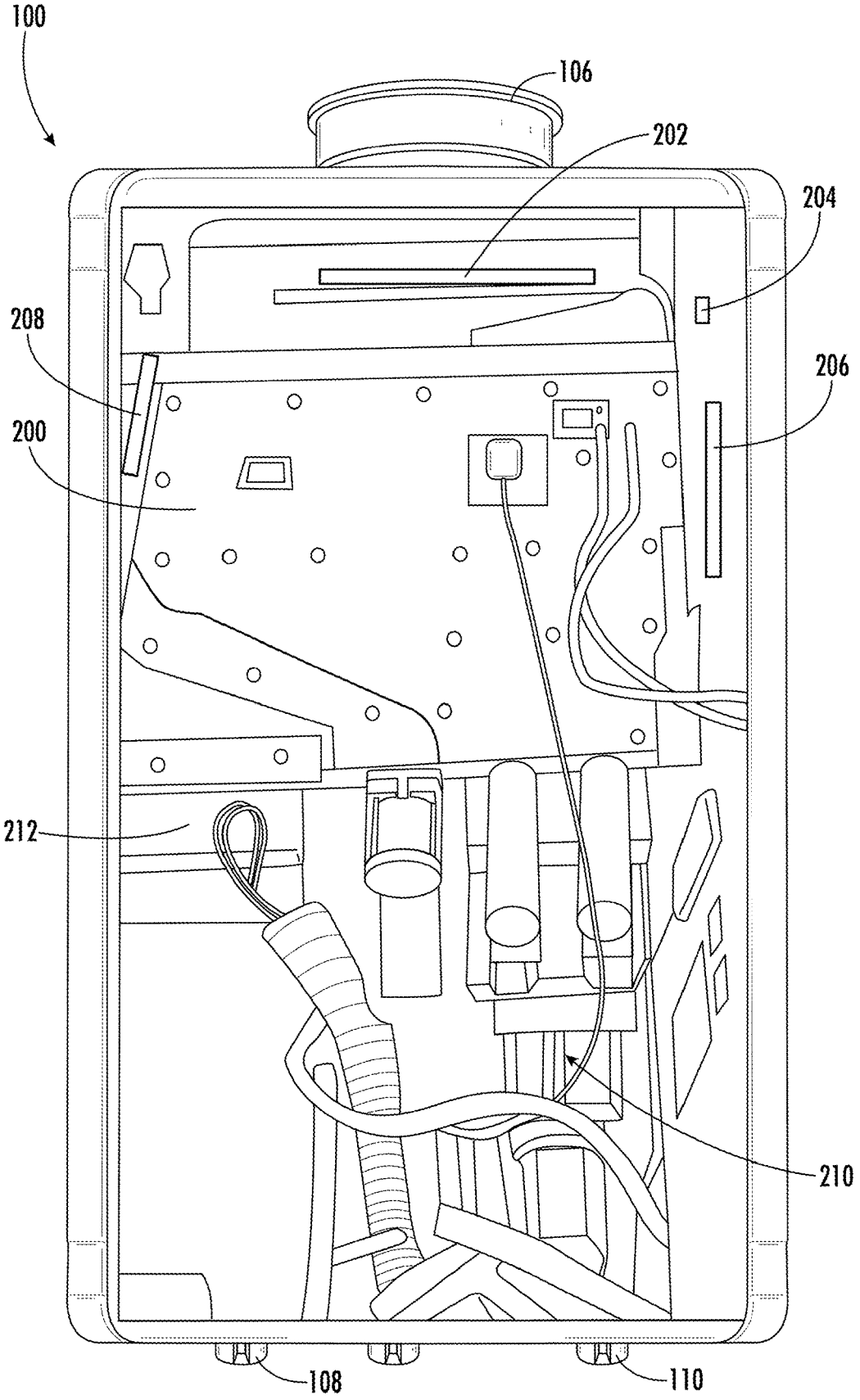
FIG. 2 provides a front view of the interior of the example water heater of FIG. 1.

FIGS. 1 and 2 illustrate an example embodiment of a water heater 100. In the present example embodiment, water heater 100 may be a gas, tankless water heater 100 and may be configured in the same or similar manner to known gas, tankless water heaters. As seen in FIG. 1, water heater 100 may include a case 102. A controller 104 may be included in or on case 102. Controller 104 will be discussed in greater detail herein. Also shown in FIG. 1, an exhaust duct connector 106 may extend out from the interior of case 102. Referring also to FIG. 2, a heat exchanger 200 is positioned on a water line 210 disposed inside case 102. Water line 210 extends from a water inlet 108 to a water outlet 110 and may pass through heat exchanger 200 in water heater 100. Water inlet 108 may be connected to a pressurized water supply, such as a well or municipal water system. Water outlet 110 may be connected to a downstream water consumption fixture, such as a dishwasher, washing machine, faucet, etc. Heat exchanger 200 may also include a burner 212, for heating up water from water line 210 passing through heat exchanger 200. Burner 212 creates combustion products, such as exhaust gases, that may exit water heater 100 through exhaust duct connector 106 to ambient atmosphere.

In the present example embodiment, water heater 100 may also include four heating elements: a first heating element 202; a second heating element 204; a third heating element 206; and a fourth heating element 208. First heating element 202 and second heating element 204 may be positioned on water line 210 above, or below, heat exchanger 200. As another example, first heating element 202 and/or second heating element 204 may be positioned on heat exchanger 200 at a top portion of heat exchanger 200. FIG. 2 depicts both first heating element 202 and second heating element 204 positioned above heat exchanger 200. Third heating element 206 and fourth heating element 208 may be positioned on heat exchanger 200. For example, in the present embodiment, third heating element 206 and fourth heating element 208 are positioned around the sides of heat exchanger 200. As another example, third heating element 206 and/or fourth heating element 208 may be positioned on water line 210 below heat exchanger 200.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 104 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 104 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

Referring again to FIG. 1, water heater 100 may include a controller 104. In some example embodiments, controller 104 may include one or more user input device 112, such as one or more of a variety of digital, analog, electrical, mechanical, or electro-mechanical input devices including rotary dials, control knobs, push buttons, toggle switches, selector switches, and touch pads. Additionally, controller 104 may include a display 114, such as a digital or analog display device generally configured to provide visual feedback regarding the operation of water heater 100. According to the present example embodiment, user input device 112 and display 114 may be integrated into the controller 104, e.g., including one or more of a touchscreen interface, a capacitive touch panel, a liquid crystal display (LCD), a plasma display panel (PDP), a cathode ray tube (CRT) display, or other informational or interactive displays.

Figure 3:
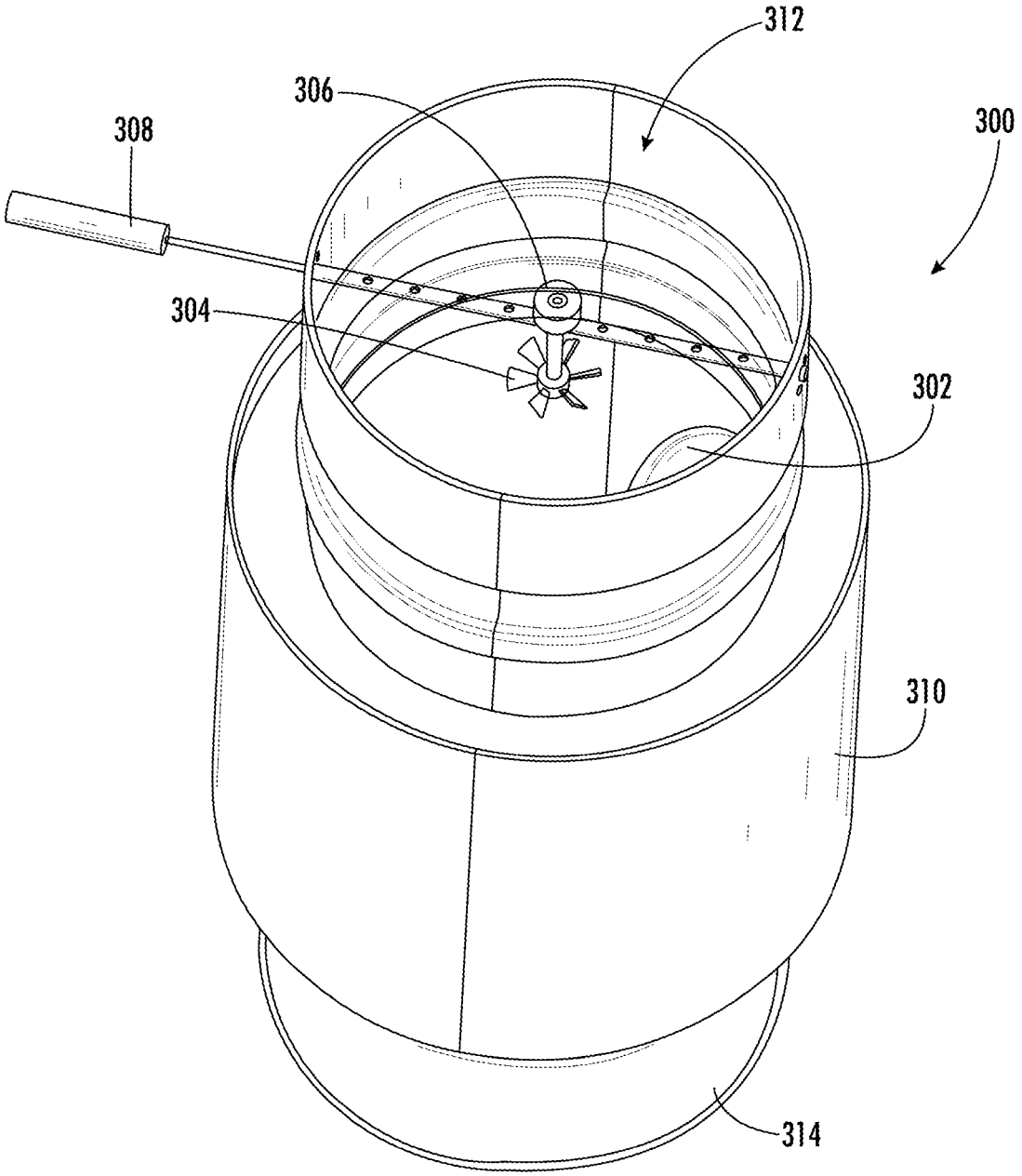
FIG. 3 provides an isometric perspective view of an example embodiment of a flue according to the present disclosure.
Figure 4:
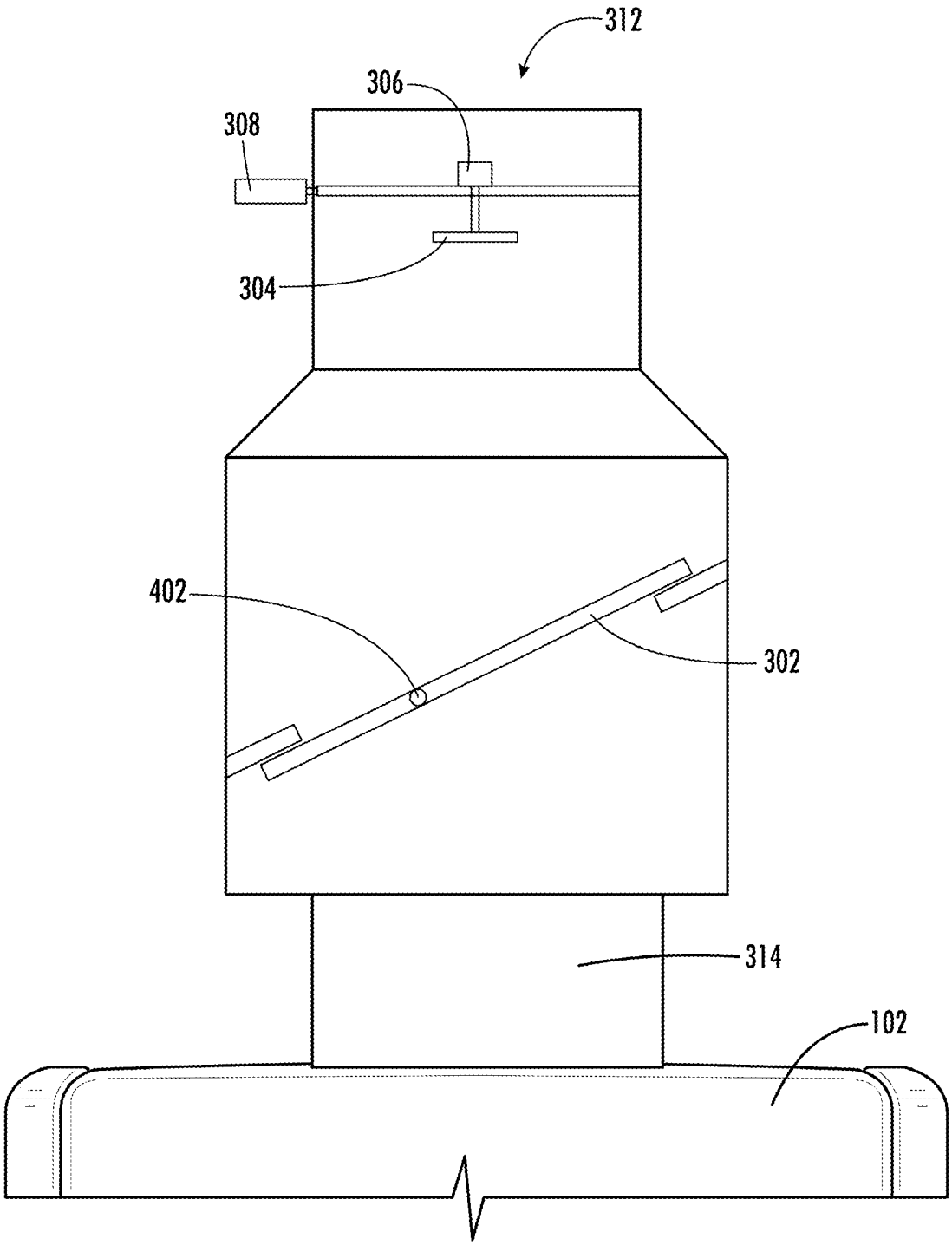
FIG. 4 provides a front section view of the example flue of FIG. 3.

FIGS. 3 and 4 illustrate an example flue 300 connected to exhaust duct connector 106 via connector 314. Flue may form at least a portion of a flow path for exhaust gases exiting water heater 100 to ambient atmosphere. Flue 300 may include a plate 302, a fan 304, a speed sensor 306, and a temperature sensor 308. Speed sensor 306 may be a sensor, such as a Hall effect sensor. Plate 302 may be located within a reverse flow hood 310 of flue 300. Plate 302 is configured to rotate within flue 300 between an open position and a closed position. Plate 302 may be positioned to let exhaust air exit flue 300 in the open position. Conversely, when plate 302 is in the closed position, plate 302 may be configured to block the exhaust air and prevent external air from entering the case through flue 300. Thus, plate 302 may rotate within flue 300 in order to selectively block exhaust gases exiting flue 300. Plate 302 may be rotatable between the open and closed positions by air within flue 300. For instance, exhaust air from burner 212 may push plate 302 into the open position, and the external air flowing into flue 300 may push plate 302 into the closed position. In certain example embodiments, plate 302 may be biased or urged towards either the open or closed positions. For example, a spring may be coupled to plate 302 and urge plate 302 towards the open position such that plate 302 is normally open. As another example, the spring may urge plate 302 towards the closed position such that plate 302 is normally closed.

As used herein, "temperature sensor" or the equivalent is intended to refer to any suitable type of temperature measuring system or device positioned at any suitable location for measuring the desired temperature. Thus, for example, temperature sensor 308 may be any suitable type of temperature sensor, such as a thermistor, a thermocouple, a resistance temperature detector, etc., or combinations thereof. In addition, temperature sensor 308 may be positioned at any suitable location and may output a signal, such as a voltage, to controller 104 that is proportional to and/or indicative of the temperature being measured. Although example positioning of temperature sensors is described herein, it should be appreciated that water heater 100 may include any other suitable number, type, and position of temperature, humidity, and/or other sensors according to alternative example embodiments.

As shown in the cross-section view of FIG. 4, when cold air flows into flue 300, through exhaust outlet 312, plate 302 may rotate into the closed position. Plate 302 is mounted in flue 300 by a hinge 402. Due to the incoming airflow, fan 304 may spin, and speed sensor 306 may signal controller 104, which may monitor speed sensor 306 and temperature sensor 308. When controller 104 receives signal(s) from speed sensor 306 and/or temperature sensor 308, controller 104 may determine, based at least in part on one or both of the signals from the temperature sensor 308 and from fan speed sensor 306, a heating response for water heater 100 and heating elements 202, 204, 206, 208. Controller 104 is in operative communication with the heating elements 202, 204, 206, 208, and the controller 104 may selectively activate the heating elements 202, 204, 206, and 208.

For example, in one example scenario, controller 104 may activate heating elements 202 and 204 for the heating response from cold air flowing into flue 300. In a second example scenario, colder air than in the first scenario may be flowing into flue 300. In this example scenario, controller 104 may activate all four heating elements 202, 204, 206, and 208 for the heating response from the colder air flowing into flue 300. In a third example scenario, with even colder air than in the second scenario, controller 104 may activate all four heating elements 202, 204, 206, and 208 and the burner 212 of water heater 100 for the heating response from the even colder air flowing into flue 300. In other words, as the external air becomes colder, a different heating response determined by controller 104 may be needed to prevent the water line 210 or the heat exchanger 200 from freezing or breaking, and heating elements 202, 204, 206, and 208 and the burner 212 may be selectively activated (e.g., in an escalating manner) in response to the increasingly cold air flowing into flue 300. The scenarios provided are provided by way of example only and are not intended to be limiting, as other scenarios may exist in which a heating response may be determined.

In the third example scenario discussed above, after the heating response is determined, controller 104 may read the water temperature from a water outlet temperature sensor (not shown), e.g., on water line 210 downstream of heat exchanger 200. When the temperature of the water flowing from water outlet 110 reaches a specified value, such as thirty-five degrees Celsius (35° C.), controller 104 may determine to change the heating response to one of the other scenario's heating responses.

As may be seen from the above, water heater 100 includes flue 300 to provide an outlet for exhaust from burner 212 of heat exchanger 200. Plate 302 is positioned inside flue 300, and configured to rotate between an open and closed position. When water heater 100 is in normal operation, plate 302 may be rotated into the open position to allow exhaust of gases from burner 212. In the open position, speed sensor 306 and temperature sensor 308 may not be monitored by controller 104. When there is cold external air flowing into flue 300, plate 302 rotates into the closed position and blocks flue 300. In the closed position, fan 304 may spin from the flow of incoming air and speed sensor 306 signals controller 104. At the same time, temperature sensor 308 may start to acquire the actual temperature of the flowing air. Both the speed and the temperature of the air will be delivered to controller 104 and a heating response may be determined as a preventive action to limit or prevent freezing of water within water line 210 within water heater 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater, comprising:

a case;

a water line disposed within the case, the water line extending between an inlet and an outlet;

a heat exchanger disposed in the case on the water line;

a burner disposed in the case;

a controller disposed in the case, the controller in operative communication with the burner and configured to selectively activate the burner in order to heat water in the water line via the heat exchanger;

a flue coupled to the case, the flue defining an exhaust outlet contiguous with external air, the flue configured to vent combustion gases from the burner to external air through the exhaust outlet, the flue comprising a temperature sensor and a fan, the fan coupled to a speed sensor, the fan spinnable via airflow through the flue;

a plate disposed within the flue, the plate configured to rotate within the flue between an open position and a closed position, the plate positioned to allow exhaust air to exit the flue in the open position of the plate, the plate configured to block the exhaust air and prevent external air from entering the case through the flue in the closed position of the plate; and a heating element coupled to the water line between the inlet and the outlet of the water line, wherein the controller is in signal communication with the temperature sensor and the speed sensor, and the controller is in operative communication with the heating element, the controller configured to selectively activate the heating element based at least in part on one or both of a signal from the temperature sensor and a signal from the speed sensor.

2. The water heater of claim 1, wherein the temperature sensor and the fan are coupled within the exhaust outlet of the flue.

3. The water heater of claim 1, wherein the controller is configured to receive a signal from the temperature sensor in response to movement of the fan.

4. The water heater of claim 1, wherein the controller is configured to monitor a speed from the speed sensor coupled to the fan and to monitor a temperature of the external air.

5. The water heater of claim 4, wherein the heating element is one of a plurality of heating elements, the plurality of heating elements comprises four heating elements, and each of the four heating elements is coupled to the water line or the heat exchanger at a respective location.

6. The water heater of claim 5, wherein the controller is configured to activate one or more of the plurality of heating elements based at least in part upon the monitored speed from the speed sensor coupled to the fan and the monitored temperature of the external air.

7. The water heater of claim 6, wherein the controller is configured to activate the plurality of heating elements and the burner of the water heater based at least in part upon the monitored fan speed and the monitored temperature of the external air.

8. The water heater of claim 1, wherein the controller is configured to selectively activate the heating element based at least in part on the signal from the speed sensor.

9. A water heater, comprising:

a housing;

a water line disposed within the housing, the water line extending between an inlet and an outlet;

a heat exchanger disposed in the housing on the water line;

a burner disposed in the housing;

an exhaust duct connector extending through the housing;

a controller disposed on the housing, the controller in operative communication with the burner and configured to selectively activate the burner in order to heat water in the water line;

a flue coupled to the exhaust duct connector, the flue defining an exhaust outlet contiguous with external air, the flue configured to vent combustion gases from the burner to external air through the exhaust outlet, the flue comprising a temperature sensor and a fan, the fan coupled to a speed sensor, the fan spinnable via airflow through the flue;

a plate disposed within the flue, the plate configured to rotate within the flue between an open position and a closed position, the plate positioned to allow exhaust air to exit the flue in the open position of the plate, the plate configured to block the exhaust air and prevent external air from entering the housing through the flue in the closed position of the plate; and a heating element coupled to the water line between the inlet and the outlet of the water line, wherein the controller is in signal communication with the temperature sensor and the speed sensor, and the controller is in operative communication with the heating element, the controller configured to selectively activate the heating element based at least in part on one or both of a signal from the temperature sensor and a signal from the speed sensor.

10. The water heater of claim 9, wherein the temperature sensor and the fan are coupled within the exhaust outlet of the flue.

11. The water heater of claim 9, wherein the controller is configured to receive a signal from the temperature sensor in response to movement of the fan.

12. The water heater of claim 9, wherein the controller is configured to monitor a speed from the speed sensor coupled to the fan and to monitor a temperature of the external air.

13. The water heater of claim 12, wherein the heating element is one of a plurality of heating elements, the plurality of heating elements comprises four heating elements, and each of the four heating elements is coupled to the water line or the heat exchanger at a respective location.

14. The water heater of claim 13, wherein the controller is configured to activate one or more of the plurality of heating elements based at least in part upon the monitored speed from the speed sensor coupled to the fan and the monitored temperature of the external air.

15. The water heater of claim 14, wherein the controller is configured to activate the plurality of heating elements and the burner of the water heater based at least in part upon the monitored fan speed and the monitored temperature of the external air.

16. The water heater of claim 9, wherein the controller is configured to selectively activate the heating element based at least in part on the signal from the speed sensor.

* * * * *